US005266437A

United States Patent [19]

Yamane et al.

[11] Patent Number: 5,266,437

[45] Date of Patent: Nov. 30, 1993

[54] ELECTROPHOTOGRAPHIC IMAGING FORMING METHOD VEINS USING TONER CONTAINING COMPLEX FINE PARTICLES

[75] Inventors: Kenji Yamane; Kazuhisa Horiuchi; Hiroshi Yamazaki, all of Hachioji, Japan

[73] Assignee: Konica Corporation, Tokyo, Japan

[21] Appl. No.: 800,209

[22] Filed: Nov. 29, 1991

[30] Foreign Application Priority Data

Nov. 30, 1990 [JP] Japan ..... 2-330268

[51] Int. Cl.[5] ..... G03G 13/14; G03G 13/09

[52] U.S. Cl. ..... 430/126; 430/122

[58] Field of Search ..... 430/106.6, 122, 125, 430/126

[56] References Cited

U.S. PATENT DOCUMENTS 5,035,973 7/1991 Kaga ..... 430/125

5,112,709 5/1992 Yamazaki et al. ..... 430/125

*Primary Examiner*—John Goodrow

*Attorney, Agent, or Firm*—Jordan B. Bierman

[57] ABSTRACT

A method of producing an electrophotographic image is disclosed. The method includes steps of forming an electrostatic latent image on the photoconductive layer, developing an electrostatic latent image, transferring the developed image to a transferee and cleaning residual toner remained on the electrostatic latent image carrier. The cleaning step is carried out in a cleaning device equipped with a cleaning roller and a cleaning blade and with a developer comprising colored particles comprising a resin, coloring agent and inorganic fine particles adhered to the colored particles.

21 Claims, 1 Drawing Sheet

ELECTROPHOTOGRAPHIC IMAGING FORMING METHOD VEINS USING TONER CONTAINING COMPLEX FINE PARTICLES

FIELD OF THE INVENTION

The present invention pertains to a method for forming an electrophotographic image particularly. The present invention relates to a process for producing an electrophotographic image including therein a developing step, an image transferring step and a cleaning step.

BACKGROUND OF THE INVENTION

Electrophotographic image forming process usually comprises a step of uniformly giving electrostatic charge on the surface of of a photoconductive element consisting essentially of an electrically conductive substrate and a photoconductive layer which is on said substrate and is capable of carrying an electrostatic charge on its surface;

a step of forming an imagewise distributed electrostatic latent image on the photoconductive layer by subjecting said photoconductive element to imagewise light exposure;

a step of developing said electrostatic latent image with a developer comprising a toner, to form a toner image on the photoconductive layer corresponding to the electrostatic latent image;

a step of electrostatically transferring the toner image to a transferee, such as a paper sheet;

a step of fixing the toner image formed on the transferee by means of pressure or heat;

a step of removing electrostatic charge formed and remaining on the photoconductive layer; and a step of removing toner remaining on the surface of the photoconductive element, to be prepared for another photocopying processes.

Heretofore, as for the cleaning apparatus for performing the cleaning step, one having a cleaning blade, which is provided so as to be in contact with the photoconductive element carrying a developed toner image formed thereon, has been widely used in the art.

However, this kind of cleaning apparatus having therein a cleaning blade has had a disadvantage that it is often difficult to completely remove certain kinds of alien substances, for example, such as paper, rosin or talc powder appearingly generated from a transferring material; a corona discharge product derived from a corona discharging device installed in the copying apparatus or a toner material which is fused adhered to the surface of the latent image carrier.

For this reason recently, a new cleaning device, in which a cleaning roller made of a resilient material such as silicone rubber, urethane rubber or fluorinated rubber is installed in contact with the surface of the latent image carrier as well as a cleaning blade for frictionally removing the residual toner from the latent image carrier, has has been proposed.

Further, for the purpose of improving the cleaning performance, the following techniques have also been proposed:

(i) a technique disclosed in Japanese Patent Publication Open to Public Inspection (hereinafter referred to as Japanese Patent O.P.I. Publication) No. 63-48586(1988), in which a cleaning roller and a cleaning blade are employed and, in addition, an inorganic fine particles are incorporated into the developer as a cleaning agent;

(ii) a technique disclosed in Japanese Patent O.P.I. Publication) No. 1-48586(1989), in which a cleaning roller and a cleaning blade are employed and, in addition, an organic fine particles are incorporated into the developer as a cleaning agent; and (iii) a technique disclosed in Japanese Patent O.P.I. Publication No. 64-91143(1989), in which a cleaning blade is employed and complex particles are incorporated into the developer.

However, in the case of technique (i), where inorganic particles are used as a cleaning agent, while repeating image formation processes the inorganic particles are liable to be caught in the area where the cleaning roller made of a resilient material and the photoconductive element come into contact, often causing a deep scratch on the surface of the cleaning roller. Then this scratch is filled up with the resinous toner, thus resulting in producing black spots or black streaks in the finally produced image.

Further, as in the case of technique(ii), where organic particles are used as the cleaning agent, the organic particles tend to be caught in the area where the cleaning roller and the photoconductive element come into contact. And, thus, while repeating the image formation processes, the organic particles come to firmly fixed to the photoconductive material, to produce an adhesion product, which can hardly be removed completely by the use of a cleaning blade. Then, this adhesion product functions as a nucleus for fusing the resinous toner material, thus to produce a toner speck which can be a cause for the formation of black spot or streak when transferred to a transferee. Furthermore, when the pressure is enhanced for purpose of enhancing cleaning performance of the cleaning blade, durability of the cleaning blade can be degraded, to a considerable degree.

Further in the case of technique(iii), where complex fine particles are used as the cleaning agent, since cleaning effect tends to be exerted distinctively only in the region where the cleaning blade and the photoconductive element come into contact, durability of the cleaning blade is deteriorated, causing occurrence of the black spots or streaks in the produced copy image derived from injury of the cleaning blade.

SUMMARY OF THE INVENTION

In view of the state of the art mentioned above, the object of the present invention is to provide a novel and improved method for producing an electrophotographic image which can make it possible for a cleaning step of the residual toner to be performed without accompanying injury or degradation in the electrostatic latent image carrier, cleaning roller and the cleaning blade.

Thus, the present invention specifically relates to a method of producing an electrophotographic image. The method comprises a step of developing an electrostatic latent image formed on an electrostatic latent image carrier with a developer; a step of transferring the thus developed toner image formed on the electrostatic latent image carrier to a transferee and a step of cleaning a residual toner remained on the electrostatic latent image carrier without being transferred to the transferee. The cleaning step is carried out by the use of a cleaning device which is provided with a cleaning roller arranged so as to be in contact with the electrostatic latent image carrier and a cleaning blade arranged at a downstream position in respect of the contact point of the cleaning roller with the electrostatic latent image carrier relative to the rotary direction of the cleaning roller. The toner contained in the developer comprises colored resin particles containing a resin and a coloring agent, and complex fine particles consisting essentially of inorganic fine particles adhered to resin particles.

DETAILED DESCRIPTION OF THE INVENTION

Figure 1:
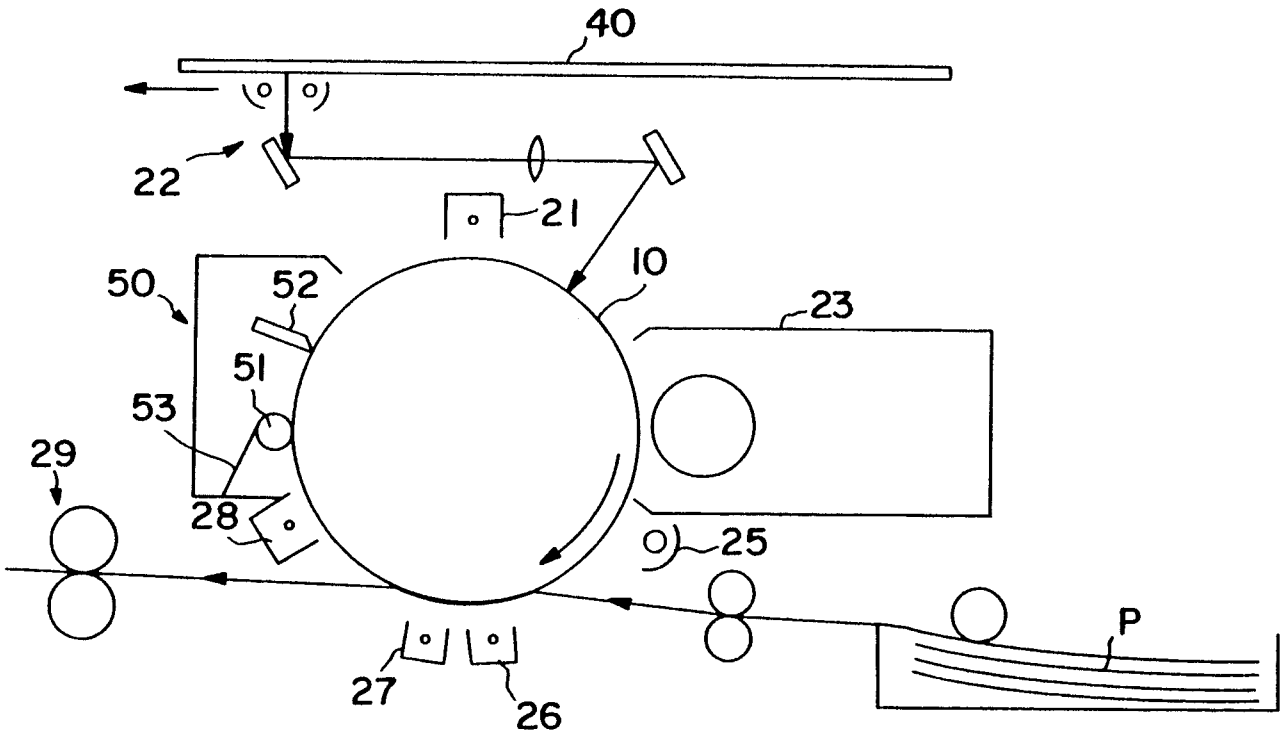
FIG. 1 is schematic outline view of an electrophotographic image producing apparatus used for performing the method of the present invention.

In the electrophotographic image forming method of the present invention, a specific toner is used. That is, the toner, which composes an essential element of a developer, comprises colored resin particles consisting essentially of a resin and a coloring agent, complex fine particles consisting essentially of inorganic fine particles adhered to the surface of a resin particle. Preferable average grain size of the resin particles which form nuclei of the complex fine particles of the invention is, in view of enhancing the cleaning ability without injuring frictional chargeability of the toner, within a range between 0.1 and 7$\mu$, and more advantageously from 0.2 to 5$\mu$.

The average particle size used in the present invention is defined as the volume-based average particle obtained from a measurement by the use of "HELOS" (manufactured by SYMPATEC Co.), which is a laser diffraction-type grain particle distribution measuring equipment with a built-in wet dispersion device. As for material used for the resin particles, various types of conventionally known resins may be used.

For example, acrylic resins, styrene resins, styrene/acrylate copolymers, fluorinated resins, silicone resins, olefin resins and olefin copolymer resins can be mentioned.

The Preferable average particle size of the inorganic fine particles to be adhered to the surface of the resin particles is, in view of enhancing cleaning performance and adhesion power to the resin particles, in a range between 0.01 and 1$\mu$ and, more preferably, 0.01 to 0.5$\mu$. Herein, the average particle size of the inorganic particles means that of the primary particles and is defined to be number average particle size determined through observation of the particles by a scanning type electron microscope and determined by image analyzing technique.

As inorganic material used for the inorganic fine particles, for example, metal oxides such as silicon oxide, aluminium oxide, titanium oxide, zinc oxide, zirconium oxide, chromium oxide, cerium oxide, tungsten oxide, antimony oxide, cupric oxide, tin oxide, tellurium oxide, manganese oxide, boron oxide, barium titanate, aluminium titanate, magnesium titanate, calcium titanate, strontium titanate; carbides such as silicon carbide, tungsten carbide, boron carbide and titan carbide and nitrides such as silicon nitride, titan nitride and boron nitride may be mentioned.

The above-mentioned complex fine particle has on its surface inorganic fine particles. In the present invention, term "inorganic fine particles adhered to the surface of the resin particles" is used not only to represent a state in which the inorganic fine particles are electrostatically fixed to the surface of the resin particles but also a state where 5-95% by length of the inorganic particles are embedded into the resin particles. These states may be confirmed by observing the surface of the complex fine particles using, for example, a scanning-type electron microscope.

In order for the inorganic fine particles to be adhered to the surface of the resin particles, it is preferable to make the resin particles spheric in shape and then the inorganic fine particles are made adhered to the surface of the resin particles. This is because when the resin particles are made spherical, the inorganic fine particles become likely to be adhered to the resin more uniformly and thus separation of the inorganic particles from the resin can be prevented more effectively.

As the means for making the resin particles sphere in shape, various technique may be applied:

(i) a method where the resin particles are first melted by heat and, then, they are made spherical using a spray granulator;

(ii) a method in which the heat-melted resin particles are subjected to jet spraying into water for spheric granulation;

(iii) a method for synthesizing spherical shape resin particles through suspension polymerization or emulsion polymerization;

and so forth may be mentioned.

As means for adhering the inorganic fine particles on the surface of the resin particles, for example, a method of mixing the inorganic fine particles with the resin particles and, thereafter adding heat to the particles and a method of mechanically adhering the inorganic fine particles to the surface of the resin particles, which is so-called mechano-chemical method may be applied.

To be more concrete, (i) a method wherein after the resin particles and the inorganic particles are mixed, the mixture is subjected to mixing process under stirring using a Henschel Mixer, a V-type Mixer, a Turbula mixer,etc., thereby to make the inorganic fine particles adhere to the surface of the resin particles by electrostatic force, and, thereafter, the resin particles, of which surface the inorganic fine particles are adhered, are introduced to a heat treatment apparatus such as a Niro Atomizer, a spray drier, etc., and soften the surface of the resin particles by heat, thus to fix the inorganic fine particles to the resin; (ii) a method in which after electrostatically adhering the inorganic fine particles to the surface of the resin particles, the inorganic fine particles are fixed to the surface of the resin particles by means of mechanical energy in an apparatus which is capable of endowing the inorganic fine particles mechanical energy and is obtained by modifying a shock endowing-type pulverizer such as an Ang mill, a free mill or a hybridizer, etc. may be applied.

Upon manufacturing the complex fine particles, amount of the inorganic fine particles to be used against the resin particles may be that which can uniformly cover the surface of the resin particles.

More specifically, the amount may be varied depending upon specific gravity of the inorganic fine particles, however,it is usually advantageous for the amount to be from 5 to 100% by weight and, more preferably, 5 to 80% by weight relative to that of the resin particles.

when the proportion is too small, cleaning ability tends to degraded. On the other hand, the proportion is too large, the inorganic fine particles become more liable to be separated from the resin particle.

The colored toner which composes the developer used in the present invention is prepared by mixing at least the above-mentioned complex particles, and the colored resin particles containing a resin and a coloring agent.

The proportional amount of the complex fine particles against the colored resin particles contained in the developer is, in view of enhancing cleaning performance without injuring frictional chargeability of the toner particles, generally 0.01 to 5.0% by weight, and, more advantageously, 0.01 to 2.0% by weight is preferable.

The average particle size of the colored resin particles is, generally speaking, in a range between 1 and 30μ.

As examples of resins used for the colored resin particles, for example, polyesters, polystyrenes, polyacrylate acrylic resins, styrene/acrylate copolymer resin and epoxy resins can be mentioned.

As for coloring agent, for example, carbon black, nigrosin dyes, Aniline blue, Calcoil blue, chrome yellow, ultramarine blue, du Pont Oil-red, Quinoline yellow, methylene blue chloride, phthalocyanine blue, marakite green oxalate, lump black, Rose Bengal,etc. can be mentioned.

The colored resin particles may be incorporated, according to necessity and circumstances, with other additives which are conventionally known and used in the art. Those additives are, for example, a charge-controlling agent like salicylic acid derivatives; a fixing performance-improving agent such as low molecular weight polyolefins, etc.

Further, for the purpose of obtaining a magnetic toner, the colored resin particles may contain fine magnetic particles, and as for such magnetic materials, for example, particles of magnetite or ferrite having an average particle size ranging from 0.1 to 2μ may be used. Amount of addition of such magnetic materials may be varied depending on the circumstances, however, generally speaking, in a range between 20 and 70% by weight with respect to the whole weight of the colored particles, excluding the amount of outer additives.

Further, in view of enhancing flowability of the toner particles consisting essentially of a mixture of the colored resin particles and the complex fine particles may be incorporated with the outer additives, for example, inorganic fine particles and, particularly fine silica particles which are made hydrophobic with a silane coupling agent, a titan coupling agent, etc.

The toner used in the present invention may be manufactured, for example, according to the following steps: First, mixing a resin, a coloring agent and, if necessary, other additives; fusing and kneading the mixture under heat application; after cooling the mixture pulverizing and classifying the kneaded mixture, to obtain colored resin particles having pre-required average particle size. Then mixing thus obtained colored resin particles with the complex fine particles in an apparatus such as a Henschel mixer, to electrostatically adhere the complex fine particles to the surface of the colored resin particles, thus to manufacture a required toner.

Developer used in the present invention may be either so-called a two-component type developer, which consists essentially of colored resin particles (toner) and magnetic carrier particles, or so-called a one-component type developer, where toner particles contain fine magnetic particles made of ferrite, magnetite, etc.

As for carrier material for which the two-component type developer, in view of enhancing durability of the developer, so-called coated carrier particles, which consist of a magnetic material such as ferrite or magnetite coated thereon with a resin such as a styrene/acrylate copolymer resin may advantageously be used.

The average particle size of the magnetic carrier is, generally, in a range between 30 and 150μ.

In the following, respective steps applied to the electrophotographic image forming process of the present invention are explained more in detail:

Development Step

Development of an electrostatic latent image formed on the photoconductive element is developed with the two-component developer or one-component developer explained above, which is supplied onto the surface of a developer transporting carrier as a thin layer, and then transported to a region where development of the latent image takes place. As the developer transporting carrier, one having a development sleeve may advantageously be used. Further, The developer transporting carrier may advantageously be one, to which biasing electric potential can be applied, and it can be composed of, for example, a cylindrical sleeve on the surface of which a developer layer is formed and a plurality of magnets provided inside the cylindrical sleeve.

The developer is transported to the development region by relative rotary movement of either the cylindrical sleeve and/or magnets.

The developer layer, formed and held on the sleeve, in order for even development to be performed, is desirably transported to the development region as a layer of an even thickness. For achieving this purpose, a blade, which may be made of either a magnetic or a non-magnetic material, is usually provided on the upstream side of the development region with respect to the rotary direction of the cylindrical sleeve in order to regulate thickness of the developer layer. To the development region, bias voltage may be applied. This bias voltage may be either a direct current potential or a direct current potential upon which an alternating current potential is superimposed.

Direct current potential can be effective to prevent the toner particles from adhering to a non-image portion or to the background portion of the electrostatic latent image. On the other hand the alternating current potential may work to enhance adhesive property of the toner to the electrostatic latent image.

Image Transfer Step

The toner image formed on the electrostatic latent image is then transferred to a suitable transferee such as paper sheet.

In this image transfer step, an electrostatic transfer process may advantageously be employed. To be more concrete, for example, a transferring device which is capable of generating direct current corona discharge is provided on the opposite side of the electrostatic latent image carrier with respect to the image transferee, and by effecting corona discharge from the rear side of the transferee, thus to transfer the toner image formed and held on the surface of the electrostatic latent image carrier to the surface of the transferee.

Cleaning Step

In this step residual toner which remains on the surface of the electrostatic latent image carrier without being transferred to the transferee in the previous step is removed from the electrostatic latent image carrier. The cleaning step may be performed by the use of a cleaning device, in which a cleaning roller arranged so as to be in pressure contact with the electrostatic latent image carrier and a cleaning blade which is arranged so as to be in pressure contact with the electrostatic latent image carrier at a downstream side of the cleaning roller with respect to the rotational direction of the electrostatic latent image carrier.

The cleaning roller is preferably arranged so as to be lightly in touch with the electrostatic latent image carrier. At the time of cleaning, it is preferable for the cleaning roller to be frictionally moved with a certain relative speed against the electrostatic latent image carrier. Also, the cleaning roller may be rotationally moved to the same direction at the same line speed with the electrostatic latent image carrier.

Further, according to one of the most preferable embodiments of the present invention, in order to scrape off the residual toner remaining on the surface of the cleaning roller, a cleaning scraper is provided so as to be in touch with the cleaning roller.

Previous to the cleaning step it is desirable to add a discharging step for the purpose of eliminating electrostatic charge remaining on the surface of the electrostatic latent image carrier, which makes the cleaning performance easier.

This discharging step may be carried out by using, for example, a corona discharger which is capable of generating alternating current corona discharge.

Fixing Step

The toner image which was transferred on to the surface of a transferee such as paper sheet in the transfer step is fixed by means of a heat fixing device or a pressure fixing device.

Herein-after the electrophotographic image forming process of the present invention is further explained with reference to the drawing:

FIG. 1 is a schematic view of a image forming apparatus used for performing the image forming process of the present invention.

In the drawing numerical references stand for as follows:

10 . . . Electrostatic Latent Image Carrier;
21 . . . Charging Device;
22 . . . Exposing Optical System;
23 . . . Developing Device;
25 . . . Discharging Lamp
26 . . . Transfer Electrode
27 . . . Separation Electrode
28 . . Discharging Electrode
29 . . . Fixing Device
40 . . . Original Table
50 . . . Cleaning Device
51 . . . Cleaning Roller
52 . . . Cleaning Blade
53 . . . Scraper For reference, in this type of electrophotographic image forming apparatus, the exposing optical system is fixed and the original table 40 is made movable.

By corona discharger 21, the surface of the electrostatic latent image carrier 10 is uniformly charged and then the surface of the charged electrostatic latent image carrier is subjected to imagewise exposure to light through an imagewise exposing optical system 22, thus to form an imagewise-distributed latent image corresponding to the original. This electrostatic latent image is then subjected to development in a developing device 23, to form a toner image corresponding to the electrostatic latent image.

Thus developed toner image is, after being exposed to light by discharging lamp 25 in order to make the transfer process easier, transferred by the use of transferring electrode 26, to a transfer sheet P.

Then the transfer sheet P, bearing thereon a developed and transferred toner image, is separated from the electrostatic latent image carrier 10 by means of separation electrode 27 and, thereafter, is undergo a fixing treatment by means a fixing device 29 to give a fixed image. The electrostatic latent image carrier 10 is discharged by means of a discharging electrode 28, and is undergo a treatment in a cleaning device 50 in order to remove residual toner remained on the surface of the electrostatic latent image carrier without being transferred to the transferee P.

The cleaning device 50 exemplified in the drawing comprises a cleaning roller 51 and a cleaning blade 52 provided at a downstream side of the cleaning roller 51 with respect to the rotational direction thereof. And the cleaning roller 51 is further provided with a scraper 53.

The cleaning blade 52 is made of, for example, a resilient material such as a hard urethane rubber having 1 to 3 mm thickness, and a length substantially corresponding to the width of the electrostatic latent image carrier 10. Further, this cleaning blade 52 is held by another holding means, which is not shown in the drawing, so as to be switched between at a pressure contact position and at a non-contact position.

The cleaning roller 51 is comprised of, for example, a cylindrical member having an approximate outer diameter of 5 to 25 mm and made of metal, and a coating covering the outer surface of the cylindrical member at a thickness of approximately 1 to 5 mm and made of a resilient material such as urethane rubber, a silicone rubber, a sponge urethane rubber or a fluorinated rubber. This cleaning roller 51 is pivotally supported by a supporting member,which is not shown in the drawing, at an upstream side of the cleaning blade 52 with respect to rotary direction of the electrostatic latent image carrier 10,so that it comes into contact lightly with the electrostatic latent image carrier 10.

The cleaning roller 51 may be one which is arranged so that it may rotate according to the rotary movement of the electrostatic latent image carrier 10, however, it is more advantageous in the present invention that the cleaning roller 51 is a driving roller, which is forcibly given a rotary movement so that the rotary direction thereof at a contacting point with the electrostatic latent image carrier 10 is the same as that of the electrostatic latent image carrier 10 and, more advantageously,t his cleaning roller 51 is arranged so that it may be forcibly moved by friction relative to the electrostatic latent image carrier 10.

Further according to another most preferable embodiment of the present invention, this cleaning roller 51 has a function to transport residual toner, which was scraped off by the cleaning blade 52 from the surface of the electrostatic latent image carrier 10, towards a scraper 53. That is to say, since the cleaning roller 51 provided right under the cleaning blade 52, the residual toner scraped off by the cleaning blade 52 drops towards the cleaning roller 51 and, then, the toner is subsequently transported to the scraper 53 and, thus the a trouble that the residual toner stagnates right under the cleaning blade 52 may be eliminated.

The scraper 53 is made of, for example, thin film plate such as a polyethylene terephthalate. By this scraper 53 the residual toner on the surface of the cleaning roller can be scraped off.

EXAMPLES

The present invention is hereinafter described more in detail with reference working examples. In the examples, the term "parts" is used in terms of "parts by weight".

Manufacture of Complex Fine Particles

A combinations of resin particles and inorganic fine particles in the amount given in Table 1 are well mixed in a V-type mixer under stir, thus to electrostatically adhere the inorganic fine particles to the surface of the resin particles. Then the mixture is introduced to an apparatus which was manufactured by modifying and improving a conventional impact-type pulverizing apparatus, giving impulsive force to the mixture and, thus to produce complex fine particles comprising resin particles and inorganic fine particles adhered to the surface of the resin particles.

Through observation of the surface of the thus produced complex fine particles by an electron microscope and a transmission-type electron microscope, it was confirmed that the inorganic particles, which were adhered to the surface of the resin particles by electrostatic force, were adhered and held on the surface of the resin particles were present in a state of being partly embedded into the surface of the resin particles.

TABLE 1

| Complex Fine Particles | Resin Particles | | | | Inorganic Fine Particles | | | |
|---|---|---|---|---|---|---|---|---|
| | No. | Resin Component | Average Particle Size (microns) | Mixing Proportion (parts) | No. | Component | Average Particle Size (microns) | Mixing Proportion (parts) |
| A | A | Polymethyl methacrylate Resin | 0.4 | 100 | B | Aluminium Oxide | 0.02 | 60 |
| B | B | Polymethyl methacrylate Resin | 0.8 | 100 | A | Titan oxide | 0.06 | 43 |
| C | C | Low Density Polyethylene | 0.25 | 100 | B | Aluminium oxide | 0.02 | 70 |
| D | D | Low density Polyethylene | 2.5 | 100 | C | Boron nitride | 0.1 | 35 |

EXAMPLE 1

Sixtyfive (65) parts by weight of styrene/acrylate resin (monomer component ratio:styrene/methyl methacrylate/butyl methacrylate=75/5/20), 35 parts of magnetite, 5 parts of polypropylene and 1 part of salcylic acid derivative as a charge controlling agent are mixed, kneaded, pulverized and classified, to obtain Colored Particles 1 having an average particle size of 11.0μ. To this Colored Particles 1, 0.4% by weight of hydrophobic fine silica powder "Aerosil R-972" (manufactured by Nippon Aerosil Co.,Ltd.) and and 0.3% by weight of "Complex Fine Powder A" were added and mixed in "Henschel Mixer", to obtain Toner 1. Then, a one-component "Developer-A", which consists only of Toner 1, was prepared.

Using this one-component "Developer-A" and an electrophotographic copying machine,i n which a selenium photoconductor as an electrostatic latent image carrier, a developing device for one-component type developer and a cleaning device equipped with a cleaning roller (which is forcibly driven at a line speed of 1.1 times as fast as that of the electrostatic latent image carrier), a cleaning blade and a scraper as shown in the drawing, repeated image formation test for the maximum copying number of up to 300,000 times was carried out under the circumstantial conditions of temperature at 22 C and relative humidity at 55%. And after every 10,000 times of copying, produced image was inspected to find out whether or not black spots or black streaks are found in the image.

Further, after every 10,000 times of copying performances, causes of the occurrence of the black spot or the black streak were inspected in the following manner:

Occurrence of the black spot or streak caused by adhesion product on the surface of the electrostatic latent image carrier The surface of the electrostatic latent image carrier after completion of cleaning step by the cleaning blade was inspected by human eyes, and when any adhesion product was observed, the produced image was inspected if or not any black spot or streak takes place at the position corresponding to that of the adhesion product on the electrostatic latent image carrier.

Occurrence of the black spot or streak caused by a scratch formed on the surface of the electrostatic latent image carrier The surface of the electrostatic latent image carrier was observed by human eyes if any scratch was found, and, when found, the produced image was inspected to find out if or not any black spot or streak takes place at the position corresponding to the scratched place on the electrostatic latent image carrier.

Occurrence of the black spot or streak caused by a injury on the cleaning blade Using an optical microscope, the cleaning blade was inspected if there is any injury on it, and if there is any, the produced image was inspected if or not any black spot or black streak is found at the position corresponding to the injured position of the cleaning blade

Occurrence of the black spot or streak caused by a scratch on the cleaning roller Using an optical microscope, the cleaning roller was inspected if there is any injury on it, and if there is any, the produced image was inspected if or not any black spot or black streak is found at the position corresponding to the scratched position on the cleaning roller.

EXAMPLE 2

One-component Developer-B was prepared in the same manner as in Example 1 except that 0.7% by weight of Complex Fine Particles B were used instead of Complex Fine Particles A.

Using this Developer-B copying test was repeated as in Example 1 and the occurrence of the black spots and streaks were evaluated in the same manner as in Example 1.

EXAMPLE 3

Hundred (100) parts by weight of polyester resin, 10 parts of carbon black, and 3 parts of polypropyrene were are mixed, kneaded, pulverized and classified, to obtain Colored Particles 3 having an average particle size of 11.0μ. To this Colored Particles 3, 0.8% by weight of hydrophobic fine silica powder "Aerosil R-805" (manufactured by Nippon Aerosil Co.,Ltd.) and 0.2% by weight of "Complex Fine Powder C" were added and mixed in "Henschel Mixer", to obtain Toner 3.

Five parts of Toner 3 and 100 parts of resin coated carrier particles, which comprise ferrite particles having an average particle size of 80μ as a core material and a styrene-acrylate resin coat covering the surface of the core material, were mixed to prepare a two component Developer C.

Using this two-component "Developer-C" and an electrophotographic copying machine "U-Bix 5500 (manufactured by Konica corporation), in which a selenium photoconductor as an electrostatic latent image carrier, a developing device for two-component type developer and a cleaning device equipped with a cleaning roller,which is forcibly driven at a line speed of 1.1 times as fast as that of the electrostatic latent image carrier, a cleaning blade and a scraper as shown in the drawing, repeated image formation test for the maximum copying number of up to 300,000 times was carried out under conditions of temperature at 25° C. and relative humidity at 55%. Then, the same evaluations as done in Example 1 were carried out.

EXAMPLE 4

Copying test and evaluation were repeated as in Example 3 except that in this example 0.2% by weight of Complex Fine Particles D were used in stead of Complex Fine Particles C, to prepare a two-component Developer D.

COMPARATIVE EXAMPLE 1

Comparative Toner was prepared in the same manner as in Example 1 except that 1.0% by weight of polymethyl methacrylate fine particles, of which average particle size of the primary particles is 0.4μ, were used instead of Complex Fine Particles A. Then, a one-component "Developer-a" was prepared.

Using this one-component "Developer-a" and the electrophotographic copying machine used in Example 1 the same image production test and evaluation were conducted in the same manner as in Example 1.

COMPARATIVE EXAMPLE 2

Comparative Toner was prepared in the same manner as in Example 1 except that 3.0% by weight of strontium titanate fine particles, of which average particle size of the primary particles is 0.5μ, were used instead of Complex Fine Particles A. Then, a one-component "Developer-b" was prepared.

Using this one-component "Developer-b"and the electrophotographic copying machine used in Example 1, the same image production test and evaluation were conducted in the same manner as in Example 1.

COMPARATIVE EXAMPLE 3

Comparative Toner was prepared in the same manner as in Example 3 except that 0.4% by weight of polymethyl methacrylate fine particles, of which average particle size of the primary particles is 0.4μ, were used instead of Complex Fine Particles C. Then, a two-component "Developer-c" was prepared.

Using this two-component "Developer-c" and the electrophotographic copying machine used in Example 3, the same image production test and evaluation were conducted in the same manner as in Example 3.

COMPARATIVE EXAMPLE 4

Comparative Toner was prepared in the same manner as in Example 3 except that 0.5% by weight of aluminium oxide fine particles, of which average particle size of the primary particles is 1.0μ, were used instead of Complex Fine Partiles C. Then, a two-component "Developer-d" was prepared.

Using this two-component "Developer-d" and the electrophotographic copying machine used in Example 3, the same image production test and evaluation were conducted in the same manner as in Example 3.

COMPARATIVE EXAMPLE 5

Using the one-component "Developer-A" and an electrophotographic copying machine, in which a selenium photoconductor as an electrostatic latent image carrier, a developing device for one-component type developer and a cleaning device only equipped with a cleaning blade, repeated image formation test for the maximum copying number of up to 300,000 times was carried out under the circumstantial conditions of temperature at 22° C. and relative humidity at 55%, and the same evaluation was carried out.

Results obtained in the Examples are given in TABLE-2.

TABLE 2

| Example No. | Developer No. | Complex Fine Particles | Occurrence of Black Spot or Streak | Cause(s) of Occurrence |
|---|---|---|---|---|
| Example-1 | A | A | None up to 300,000th copy | None |
| Example-2 | B | B | None up to 300,000th copy | None |
| Example-3 | C | C | None up to 300,000th copy | None |
| Example-4 | D | D | None up to 300,000th copy | None |
| Comparative Example-1 | a | — | Occurred after 90,000th copy | (i) |
| Comparative Example-2 | b | — | Occurred after 140,000th copy | (ii), (iii), (iv) |
| Comparative Example-3 | c | — | Occurred after 100,000th copy | (i) |
| Comparative Example-4 | d | — | Occurred after 130,000th copy | (ii), (iii), (iv) |
| Comparative | A | A | Occurred after | (iii) |

TABLE 2-continued

| Example No. | Developer No. | Complex Fine Particles | Occurrence of Black Spot or Streak | Cause(s) of Occurrence |
|---|---|---|---|---|
| Example-5 | | | 210,000th copy | |

Under Note:
(i) Adhesion product on the surface of the electrostatic latent image carrier.
(iii) Injury on the cleaning blade.
(iv) Injury on the cleaning roller.
(ii) injury on the surface of the electrostatic latent image carrier.

It is apparent from TABLE-2 that in accordance with the method of the present invention, copying reproduction of the original image can be performed without accompanying production of an adhesion material on the surface of the electrostatic latent image carrier and injuries on the the electrostatic latent image carrier, cleaning roller or the cleaning blade.

What is claimed is:

1. A method of producing an electrophotographic image comprising uniformly placing an electrostatic charge on a surface of an electrostatic latent image carrier comprising an electrically conductive substrate and a photoconductive layer thereon;

forming an electrostatic latent image on said photoconductive layer by subjecting said photoconductive layer to imagewise light exposure;

developing said electrostatic latent image with a developer containing a toner to form a toner image;

transferring said toner image to a transferee leaving residual toner on said carrier; and removing said residual toner by using a cleaning device comprising a cleaning roller which is in contact with said carrier at a first point, and a cleaning blade in contact with said carrier at a second point downstream of said first point relative to rotation of said carrier; and said toner comprising colored resin particles which comprises a first resin and a coloring agent, and complex fine particles comprising second resin particles and inorganic fine particles adhered to surfaces of said second resin particles.

2. The method of claim 1 wherein said magnetic material is magnetite or ferrite.

3. The method of claim 1 wherein said magnetic particles have an average particle size of 30 to 150μ.

4. The method of claim 1 wherein said second resin particles have an average particle size of 0.01 to 7μ.

5. The method of claim 1 wherein said magnetic material is selected from magnetite and ferrite.

6. The method of claim 1 wherein said coloring agent is selected from the group consisting of carbon black, Nigrosin dye, Aniline Blue, Calcoil Blue, Chrome Yellow, Ultramarine Blue, du Pont Oil-red, Quinoline Yellow, Methylene Blue Chloride, Phthalocyanine Blue, Marakite Green Oxalate, Lump Black and Rose Bengal.

7. The method of claim 1, wherein said inorganic fine particles are made of a material selected from the group consisting of silicon oxide, aluminium oxide, titanium oxide, zinc oxide, zirconium oxide, chromium oxide, cerium oxide, tungsten oxide, antimony oxide, cupric oxide, tin oxide, tellurium oxide, manganese oxide, boron oxide, barium titanate, aluminium titanate, magnesium titanate, calcium titanate, strontium titanate, silicon carbide, tungsten carbide, boron carbide, titan carbide, silicon nitride, titan nitride and boron nitride.

8. The method of claim 7, wherein said inorganic fine particles have an average particle size falling in a range from 0.01 to 1μ.

9. The method of claim 8, wherein the inorganic fine particles have an average particle size of 0.01 to 0.50μ.

10. The method of claim 1 wherein said colored particles have an average particle size of 1 to 30μ.

11. The method of claim 4 wherein said second resin particles have an average particle size of 0.2 to 5μ.

12. The method of claim 11 wherein said second resin particles are of a material selected from a group consisting of acrylic resins, styrene resins, fluorinated resins, silicone resins, styrene/acrylate copolymers, and olefin copolymers.

13. The method of claim 1 wherein said first resin particles are of a material selected from the group consisting of polyesters, polystyrenes, polyacrylate acrylic resins, styrene/acrylate copolymers, and epoxy resins.

14. The method of claim 1 wherein said developer comprises 0.01% to 5.0% by weight of said complex fine particles based on said colored particles.

15. The method of claim 14 wherein said developer comprises 0.01% to 2.0% by weight of said complex fine particles based on said coloring particles.

16. The method of claim 7 wherein said complex fine particles comprises 5% to 100% by weight of said inorganic fine particles based on said second resin.

17. The method of claim 16 wherein said complex fine particles comprise 5% to 80% by weight of said inorganic fine particles base on said second resin particles.

18. The method of claim 1 wherein said second resin particles are spheric in shape.

19. The method of claim 1 wherein said cleaning blade is of a hard urethane rubber.

20. The method of claim 1 wherein said first resin particles and said second resin particles have the same composition.

21. The method of claim 1 wherein said developer comprises said colored particles, said complex fine particles, and magnetic particles consisting essentially of a magnetic core material and a resin coated on the surface of said core material.

* * * * *